US005812921A

United States Patent [19]

Van Reuth

[11] Patent Number: 5,812,921

[45] Date of Patent: Sep. 22, 1998

[54] MAGNET SYSTEM FOR AN IMAGE-FORMING APPARATUS

[75] Inventor: Norbertus G. C. M. Van Reuth, Venlo, Netherlands

[73] Assignee: Oce-Nederland, B.V., Venlo, Netherlands

[21] Appl. No.: 745,088

[22] Filed: Nov. 7, 1996

[30] Foreign Application Priority Data

Nov. 7, 1995 [EP] European Pat. Off. ..... 95203001

[51] Int. Cl.[6] ..... G03G 15/09

[52] U.S. Cl. ..... 399/276; 399/277

[58] Field of Search ..... 399/267, 269, 399/276, 277; 346/74.2

[56] References Cited

U.S. PATENT DOCUMENTS

| | | | |
|---|---|---|---|
| 3,639,051 | 2/1972 | Charlap et al. | 399/268 |
| 3,894,513 | 7/1975 | Stanley et al. | 399/267 X |
| 4,459,345 | 7/1984 | Probst | 399/267 X |
| 5,247,317 | 9/1993 | Corver et al. | 399/276 X |
| 5,319,334 | 6/1994 | Klerken | 399/269 |
| 5,529,628 | 6/1996 | Fuchiwaki et al. | 399/276 |

FOREIGN PATENT DOCUMENTS

| | | |
|---|---|---|
| 182930 | 11/1984 | European Pat. Off. . |
| 304983 | 3/1989 | European Pat. Off. . |
| 573096 | 12/1993 | European Pat. Off. . |
| 31011500 | 1/1981 | Germany . |
| 3046203 | 2/1991 | Japan . |

*Primary Examiner*—Fred L. Braun

*Attorney, Agent, or Firm*—Birch, Stewart, Kolasch & Birch, LLP

[57] ABSTRACT

A magnet system for an image-forming apparatus comprising an image-forming element which is capable of electrically and/or magnetically attracting a toner powder and is movable relative to the magnet system. The magnet system includes a support at least one ferromagnetic body and a clamping device. The support is surrounded by a rotatable sleeve and arranged such that the circumferential surface of the sleeve faces the surface of the image-forming element in a linear image-forming zone extending normal to the direction of movement of the image forming element. The at least one ferromagnetic body has magnets fixed in the support and defines a localized magnetic field in the image-forming zone. The clamping device will engage the ferromagnetic body to secure the body in the support in a non-positive manner, thereby allowing differential thermal expansion of the magnets and the support.

26 Claims, 10 Drawing Sheets

MAGNET SYSTEM FOR AN IMAGE-FORMING APPARATUS

FIELD OF THE INVENTION

The invention relates to a magnet system for an image forming apparatus comprising an image forming element which is capable of electrically and/or magnetically attracting a toner powder and is movable relative to the magnet system. The magnet system has a support surrounded by a rotatable sleeve and arranged such that the circumferential surface of the sleeve faces the surface of the image forming element in a linear image forming zone extending normal to the direction of movement of the image forming element. The magnet system further has at least one ferromagnetic body comprising magnets fixed in the support and defining a localized magnetic field in the image forming zone.

DESCRIPTION OF THE BACKGROUND ART

Image-forming apparatus to which the invention is applicable are exemplified in EP-A1-0 304 983 and EP-A1-0 573 096. In the first-mentioned document, the magnet system includes a ferromagnetic knife creating a magnetic field which mainly extends normal to the surface of the image forming element. In the second document the magnet system is of a type in which the ferromagnetic bodies comprise two pole shoes arranged along said image forming zone with a predetermined clearance therebetween. The poles shoes will create a magnetic field which extends mainly in parallel with the direction of movement of the image forming element.

The general function principle of the above-mentioned image forming apparatus and the construction of a conventional magnet system will now be explained in conjunction with FIG. 11 of the drawings. The image-forming element is a drum 10 which rotates in the direction indicated by an arrow (counter-clockwise in FIG. 11). The magnet system 12 comprises a stationary support 14 which is formed by a cylindrical body of aluminum disposed near the circumferential surface of the drum 10 and extending in parallel with the rotational axis of the drum. The support 14 is surrounded by a non-magnetic or magnetic cylindrical sleeve 16 which is driven to rotate in the same sense as the drum 10 (i.e. counter-clockwise). An image-forming zone 18 is defined in a region where the surface of the sleeve 16 comes close to the surface of the drum 10, with a little clearance remaining between these two surfaces.

A ferromagnetic knife 20 formed by a steel strip is disposed radially in a recess of the support 14 such that its outer edge faces the image forming zone 18. The opposite edge of the knife 20 is surrounded by three permanent magnets 22 which are so oriented that their respective north poles face the knife 20. Thus, a magnetic field will emerge from the outer edge of the knife 20 and will pass through the sleeve 16 and the image-forming zone 18 in a direction essentially perpendicular to the surface of the drum 10.

The drum 10 is provided with a plurality of endless electrodes 24 which extend in parallel along the circumference of the drum and are covered by an insulating surface layer 26. The surface portion of the drum 10 which approaches the image-forming zone 18 is covered with a uniform layer of toner powder 28 which has been applied by means of a magnetic toner application roller (not shown). In the image-forming zone 18 the toner powder 28 is subject to the magnetic field created by the knife 20. When a voltage is applied between the electrode 24 and the grounded sleeve 16, the toner powder is also subject to an electric field. Depending on the voltage applied to the electrode 24, the toner powder is either removed from the drum 10 and transferred to the sleeve 16 or it is left on the surface of the drum 10. Thus, a toner image can be formed on the surface of the drum 10 by appropriately controlling the voltages applied to the various electrodes 24. The pixel size of the toner image thus formed is determined by the pitch of the electrodes 24 and by the width of the magnetic field formed by the knife 20. In order to obtain a good image quality, it is essential that the knife 20 is positioned correctly and the knife and the magnets 22 are firmly secured in the support 14.

To this end, the knife 20 and the magnets 22 have heretofore been bonded into the support by means of an adhesive such as epoxy resin. Since the length of the drum 10 and the magnet system 12 corresponds to the width of the image to be formed and may amount to 30 cm or more, each of the three magnets shown in FIG. 11 is lengthwise divided into six separate blocks. In order to avoid a distortion of the magnetic field, the block boundaries in the three rows of magnets should be offset from each other, so that at least one block in one row is again split into two halves.

In a first step of a conventional method for assembling the magnet system, the first six magnet blocks are disposed in the bottom of the recess of the support 14 and are fixed by means of adhesive. The time for curing the adhesive amounts to approximately 24 hours. Then, the remaining twelve magnet blocks are bonded to the opposite sides of the knife 20. After curing of the adhesive, the unit consisting of the knife and the magnets on the opposite sides thereof is inserted into the recess of the support 14 and is bonded to the magnets already present therein. Since the magnets repel each other, the knife unit must provisionally be adjusted and held in position by means of vices, until the adhesive has cured. Finally, the remaining spaces, e.g. 30, in the recess of the support 14 are filled with epoxy resin, and then the outer edge of the knife 20 and possibly the whole cylindrical surface of the support 14 are ground to make the knife 20 flush with the surface of the support and provide a sufficiently smooth surface on which the sleeve 16 can, rotate.

The process described above is cumbersome and time consuming. Another major drawback results from the fact that the thermal expansion coefficient of the magnets (e.g. NdFeB) is significantly smaller than that of the support 14 (aluminum). Since the knife 20 and the support 14 are rigidly locked to each other via the adhesive and the magnets 22, the magnet system 12 as a whole tends to bend, when its temperature is raised or lowered. As a result, the surrounding sleeve 16 which has only a thickness in the order of 100 $\mu$m will be bent as well. The tolerance between sleeve 16 and support 14 is only about 30 $\mu$m. If the support bends more, the sleeve will be blocked from rotating.

As a counter measure, it is possible to bond a compensation rod (not shown) into a recess 32 which is arranged diametrically opposite to the knife 20. However, it is difficult to properly select the dimensions and position of the compensation rod such that the bending moment induced by the compensation rod balances the bending moment induced by the knife 20. This makes the manufacturing process even more complicated and time consuming. In addition, since the bending effect depends largely on the properties of the adhesive which will not always be exactly the same, it is not possible to achieve reproducible results, even when a compensation rod is used.

SUMMARY OF THE INVENTION

It is accordingly an object of the invention to provide a magnet system which is easy to manufacture and has an improved stability under varying temperature conditions.

To achieve this object, the invention provides a magnet system for an image forming apparatus comprising an image-forming element and a rotatable sleeve. The image-forming element electrically and/or magnetically attracts a toner powder, and the image-forming element is movable relative to the magnet system. The magnet system comprises a support, at least one ferromagnetic body and clamping means. The support is surrounded by the rotatable sleeve and is arranged such that the circumferential surface of the sleeve faces the surface of the image forming element in a linear image forming zone extending normal to the direction of movement of the image forming element. The at least one ferromagnetic body comprises magnets fixed in said support and defines a localized magnetic field in said image forming zone. The clamping means engages the ferromagnetic body to secure the same in the support in a non-positive manner, thereby allowing differential thermal expansion of the ferromagnetic body and the support.

Under changing temperature conditions, the magnets, of the magnet system according to the invention are allowed to freely expand and shrink independently of the support, so that no substantial bending of the support and hence the sleeve will be induced. On the other hand, in radial and tangential directions, the ferromagnetic body is securely held in position by the clamping means, so that the geometry of the magnetic field and hence the position and dimensions of the image forming zone are accurately defined and will not undergo any substantial changes throughout the lifetime of the magnet system.

The invention further has the advantage that the time and labor required for assembling the magnet system is greatly reduced. Since it is no longer necessary to bond the magnets, the knife, etc. to the support by means of adhesive, no preparatory treatment of the bonding surfaces with solvent is necessary in order to remove oil residues or other contaminants. This not only saves labor, but is also beneficial from the viewpoint of environment protection.

In addition, the time required for the manufacturing process is reduced significantly, because the lengthy curing periods can be eliminated or at least can be reduced in number.

Another appreciable advantage is that substantially no adhesive is present at the surface of the support in the vicinity of the magnets and the knife. Accordingly, the surface can be ground and finished without the risk of staining the grinding tools with adhesive. The risk that the adhesive stains the interior surface of the sleeve and causes the sleeve to jam will also be eliminated. It is even possible to provide the support and the ferromagnetic bodies with a surface treatment such as plating in order to obtain a smooth support surface for the rotating sleeve.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
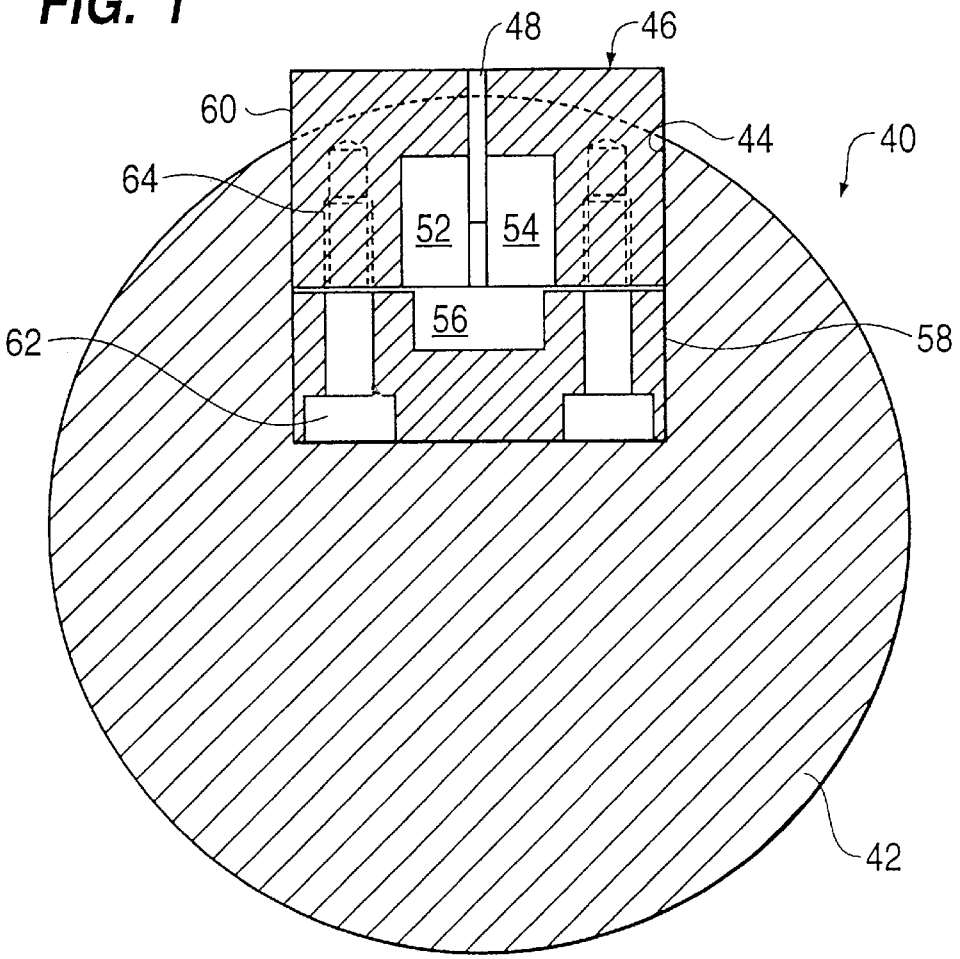
FIG. 1 is a cross-sectional view of a magnet system according to a first embodiment of the invention.

As is shown in FIG. 1, a magnet system 40 according to the invention comprises a support 42 which is formed by a solid cylindrical body made of aluminum. A recess 44 is formed longitudinally in the circumferential surface of the support 42 and houses a jig 46 the cross-section of which is complementary to that of the recess 44. The jig 46 defines a longitudinally extending slot 48 for accommodating a ferromagnetic knife 50 (FIG. 2), as well as three channels 52, 54, 56 with a rectangular cross-section for accommodating three rows of permanent magnets. The jig 46 also serves as clamping means for securing the knife and the magnets in the support 42.

The jig 46 has a two-part construction comprising a base 58 which defines the channel 56 and a cap 60 defining the slot 48 and the channels 52, 54 on opposite sides of this slot. The base 58 is provided with stepped holes 62 through which fastening screws (not shown) can be inserted from the bottom and screwed into threaded bores 64 of the cap 60 so as to tighten the base and the cap together.

Figure 2:
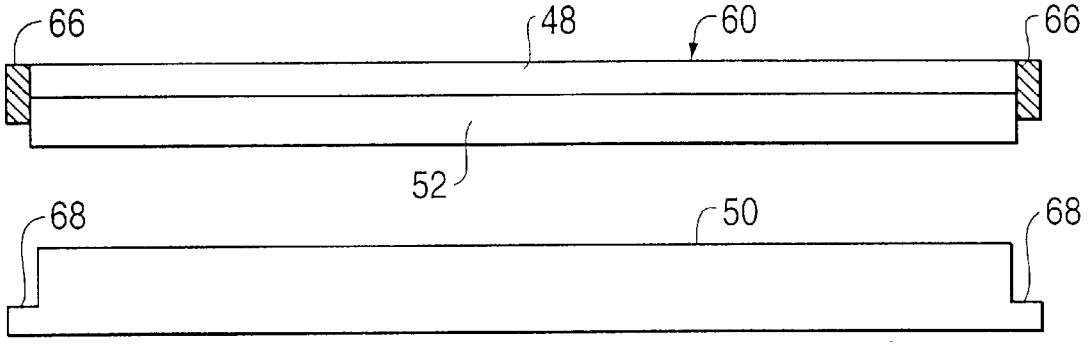
FIG. 2 is an exploded side elevation of a jig and a ferromagnetic knife to be held therein, the jig being shown in longitudinal section.

As is shown in FIG. 2, the cap 60 is provided with end walls 66 which delimit the slot 48 and the upper parts of the channels 52, 54. The knife 50 is formed with hook portions 68 projecting from the opposite ends thereof. The lower edges of the hook portions 68 are flush with the lower edge of the knife 50 itself. When the knife is inserted into the slot 48 from below, the hook portions 68 will engage the lower surfaces of the end walls 66 of the cap 60. In this condition, the lower edge of the knife 50 will be flush with the bottom surface of the cap 60.

To assemble the magnet system 40, the knife 50 is at first inserted into the slot 48 as has been described above. Then, the magnets are placed in the channels 52 and 54 with opposite polarities, so that they tend to repel each other. Since the cross-sectional shape of the magnets mates with the cross-sectional shape of the channels 52 and 54, the knife and the magnets will be held securely in the cap 60. The end walls 66 of the cap prevent the magnets from slipping out at the ends of the respective channels. Then, the base 58 is fitted to the cap 60, and the fastening screws are screwed-in to some extent, but are not yet tightened completely, so that a certain gap remains between the opposing surfaces of the base and the cap. The remaining magnets can then be pushed into the channel 56 from the open ends thereof. When the fastening screws are tightened, the magnets located in the channel 56 are held in firm abutting engagement with the magnets in the channels 52 and 54 and with the lower edge of the knife 50, so that the whole unit is firmly held together in spite of the repelling forces of the magnets.

The whole unit constituted by the jig 46, the knife 50 and the magnets is then inserted into the recess 44 and is secured therein by bonding with an adhesive such as epoxy resin. The adhesive is preferably applied in such a manner that it will not be squeezed-out between the side walls of the jig 46 and the internal walls of the recess 44. Thus, no epoxy resin will be present at the surface of the support 42.

As can be understood from FIG. 1, the jig 46 (and also the knife 50) are so dimensioned that they project beyond the cylindrical surface of the support 42. In a final step, the magnet unit 40 will therefore be ground or milled to make the jig 46 and the knife 50 flush with the circumferential cylindrical surface of the support. The whole cylindrical surface of the magnet system can then be polished and plated, if desired, in order to provide a smooth support surface for a surrounding rotatable sleeve (such as the sleeve 16 which has been described in the introductory part in conjunction with FIG. 11).

The knife 50 is matingly engaged between the longitudinal walls of the slot 48 and will therefore have no play in a tangential direction of the cylindrical support 42. Because of the hook portions 68 abutting at the end walls 66 of the cap 60, the knife 50 will have no play in the radial direction, neither. However, the length of the main portion of the knife 50 (without the hook portions 68) is slightly smaller than the length of the slot 48, so that the knife will have some longitudinal play between the end walls 66 of the cap. The jig 46 is made of aluminum just as the support 42, so that the jig and the support will have the same thermal expansion coefficient, whereas the knife 50 is made of ferromagnetic steel. When the temperature of the magnet system changes, the above-mentioned longitudinal play of the knife 50 permits free thermal expansion of the magnets of the knife irrespective of the thermal expansion of the jig and the support, so that no bending moments will be exerted on the support, and the magnetic field created by the knife 50 and the magnets will retain its geometrical shape with high accuracy.

It will be understood that the fastening screws threaded into the bores 64 will be made of a non-magnetic material such as brass, in order to avoid a distortion of the magnetic field.

Figure 3:
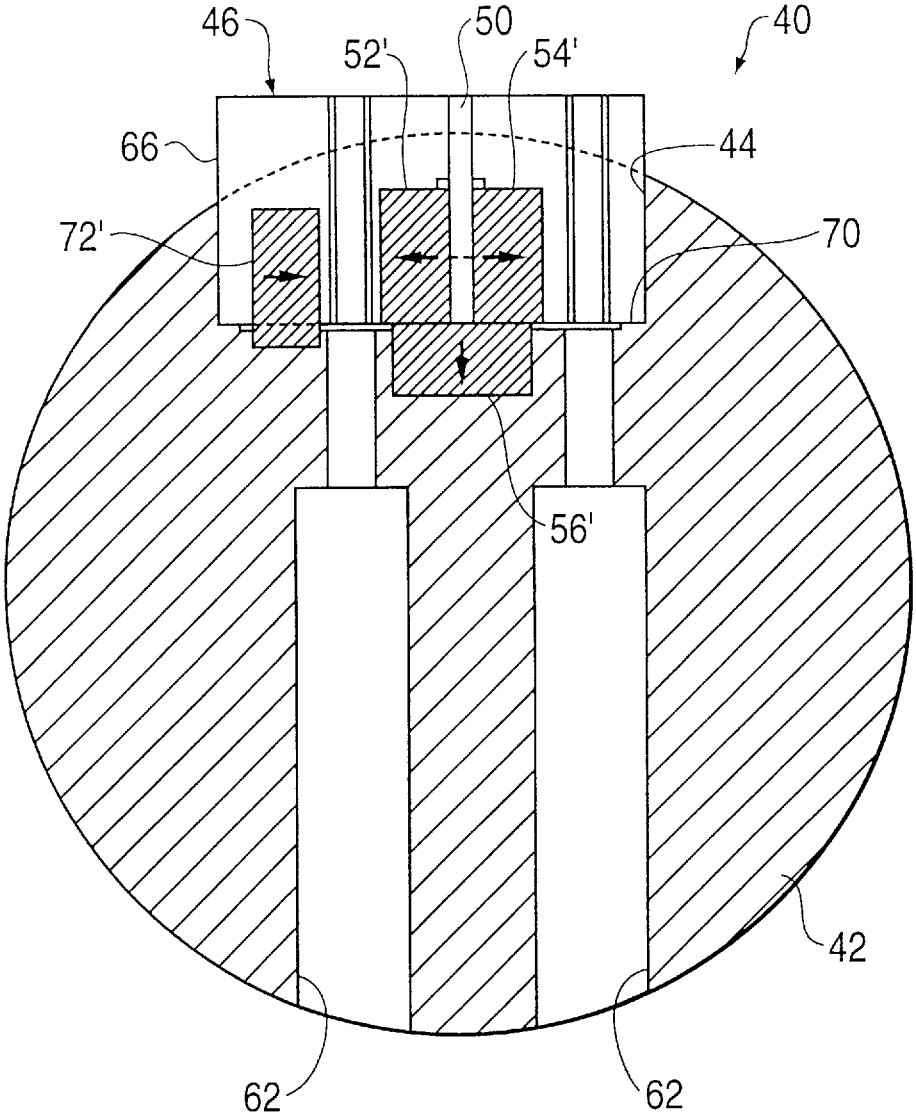
FIG. 3 is a cross-sectional view of another embodiment which includes an auxiliary magnet.

FIG. 3 illustrates a modified embodiment. Here, the magnets 52', 54' and 56' are shown in position in their respective channels. The embodiment of FIG. 3 is different from that shown in FIG. 1 in that the jig 46 has a one-piece construction, i.e. consists only of the cap 60. The channel for accommodating the magnet 56' and the stepped holes 62 for the fastening screws are formed directly in the support 42. The recess 44 of the support is formed with a flat step 70 at the longitudinal edges of its bottom surface, so that the central area of the bottom surface is slightly spaced apart from the lower surface of the cap 60. Thus, the magnets 52' and 54' and the knife 50 on the one hand and the magnet 56' on the other hand can be firmly clamped together by tightening the fastening screws.

Figure 11:
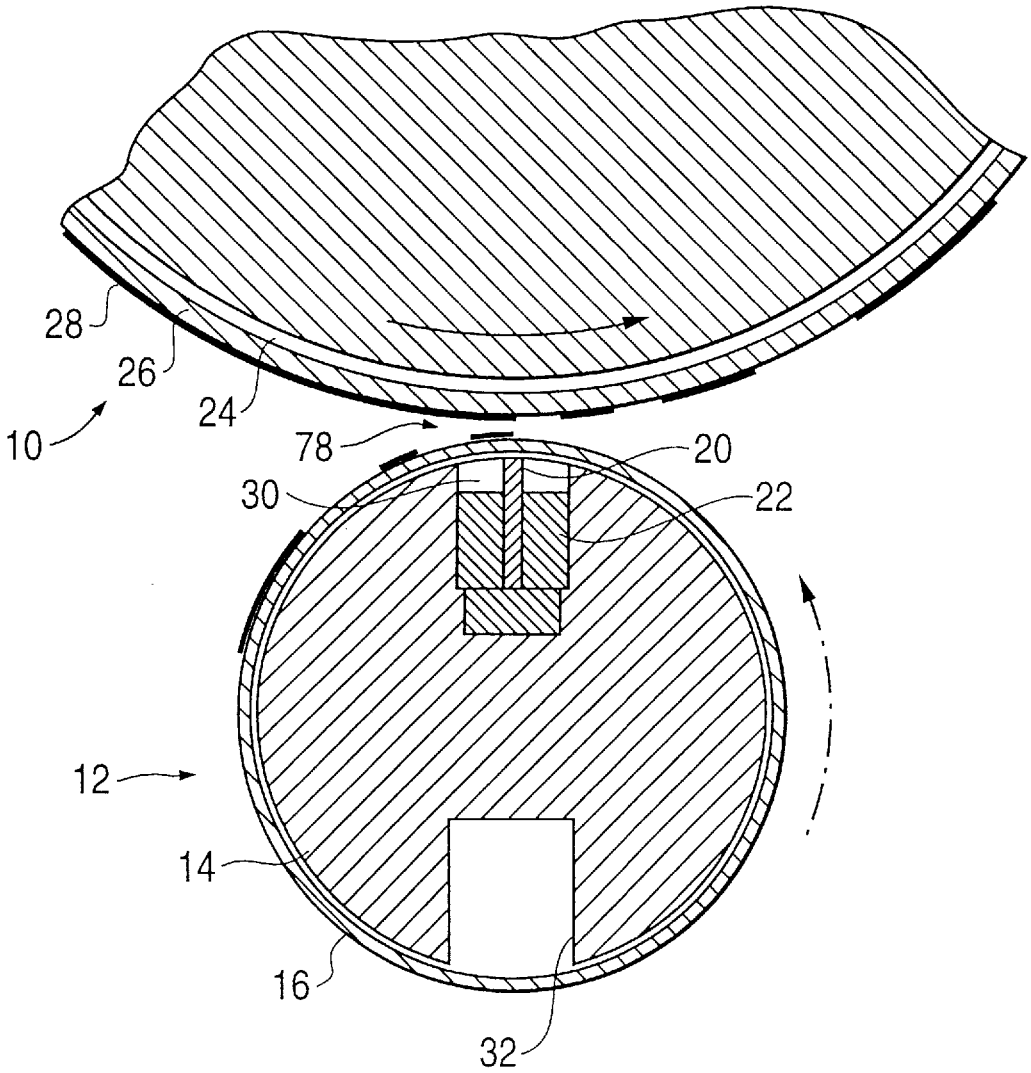
FIG. 11 (PRIOR ART)
FIG. 11 is a schematic cross-sectional view of an image-forming system with a conventional magnet system.

According to this embodiment, the jig 46 is extended to one side (to the left in FIG. 3) and defines another channel for an auxiliary magnet 72' which serves to improve the discharge of toner from the developing zone 18 (FIG. 11). The polarities of the magnets are indicated by arrows in FIG. 3.

Figure 4:
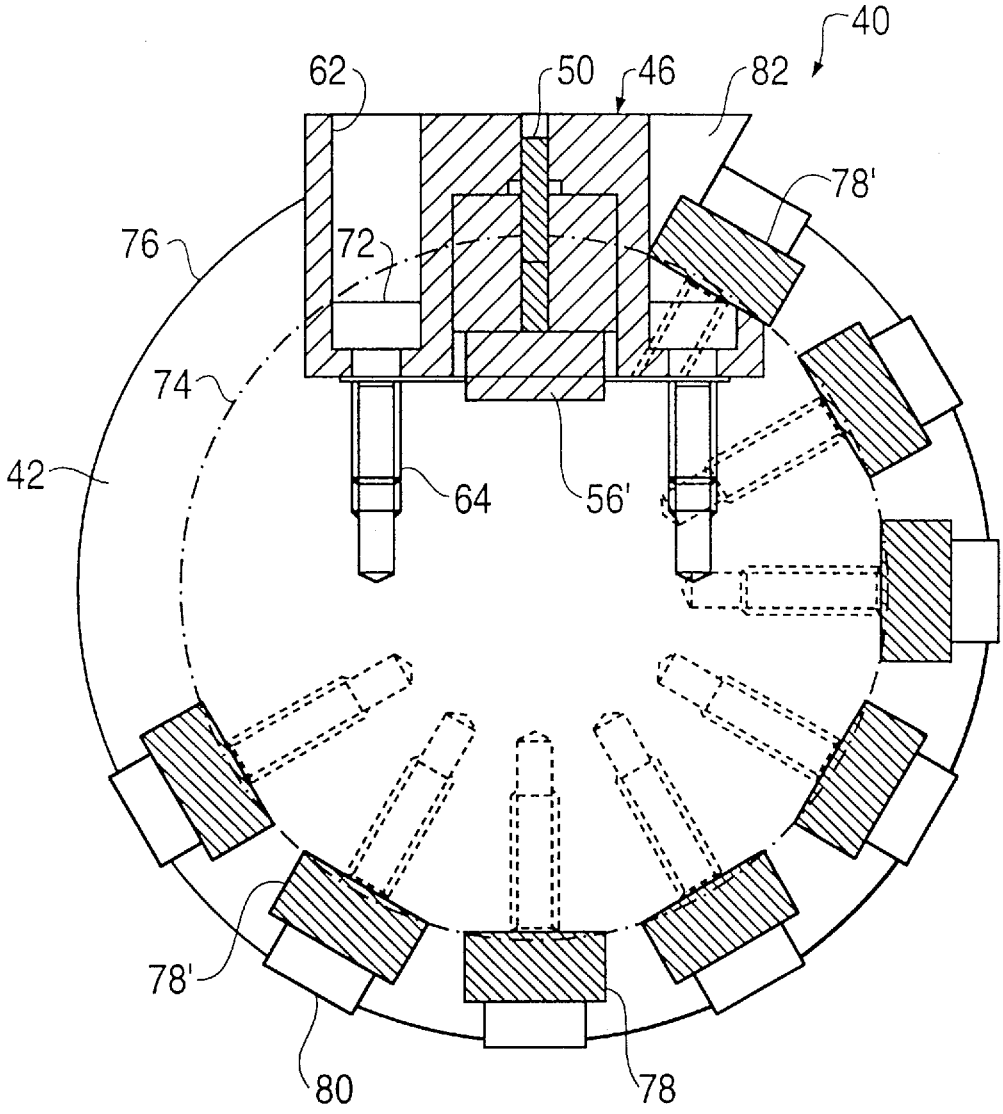
FIG. 4 is a schematic cross-sectional view of another embodiment including a number of dust-removing magnets.

In the embodiment shown in FIG. 4, the stepped holes 62 for the fastening screws 72 are formed in the one-piece jig 46, and the threaded bores 64 are provided in the support 42, so that the fastening screws 72 can be screwed on the outer surface of the jig 46. In other respects, the configuration of the jig and the corresponding recess in the support is similar to the configuration shown in FIG. 3. The elements 80 are aluminum butt-straps which can be screwed on support 42 so that the magnets 78' are clamped on support 42.

When the magnet system 40 shown in FIG. 4 is employed in an image forming system as shown in FIG. 11, the toner which has been removed from the drum 10 is conveyed on the outer surface of the sleeve 16 to a toner collecting box (not shown). The path along which the toner powder is conveyed on the surface of the sleeve 16 extends over an arc of about 100° around the axis of the support 42. The dust removing magnets 78' are provided in the remaining circumferential portions of the support and have the function of attracting the toner dust which has escaped from the toner collecting box, so that the dust will adhere to the surface of the sleeve 16 and will be returned to the toner brush formed over the knife 50, thereby preventing the surrounding parts from being stained with toner dust.

The jig 46 is formed with a recess 82 adapted to accommodate the magnet 78' which is closest to the knife 50.

Figure 5:
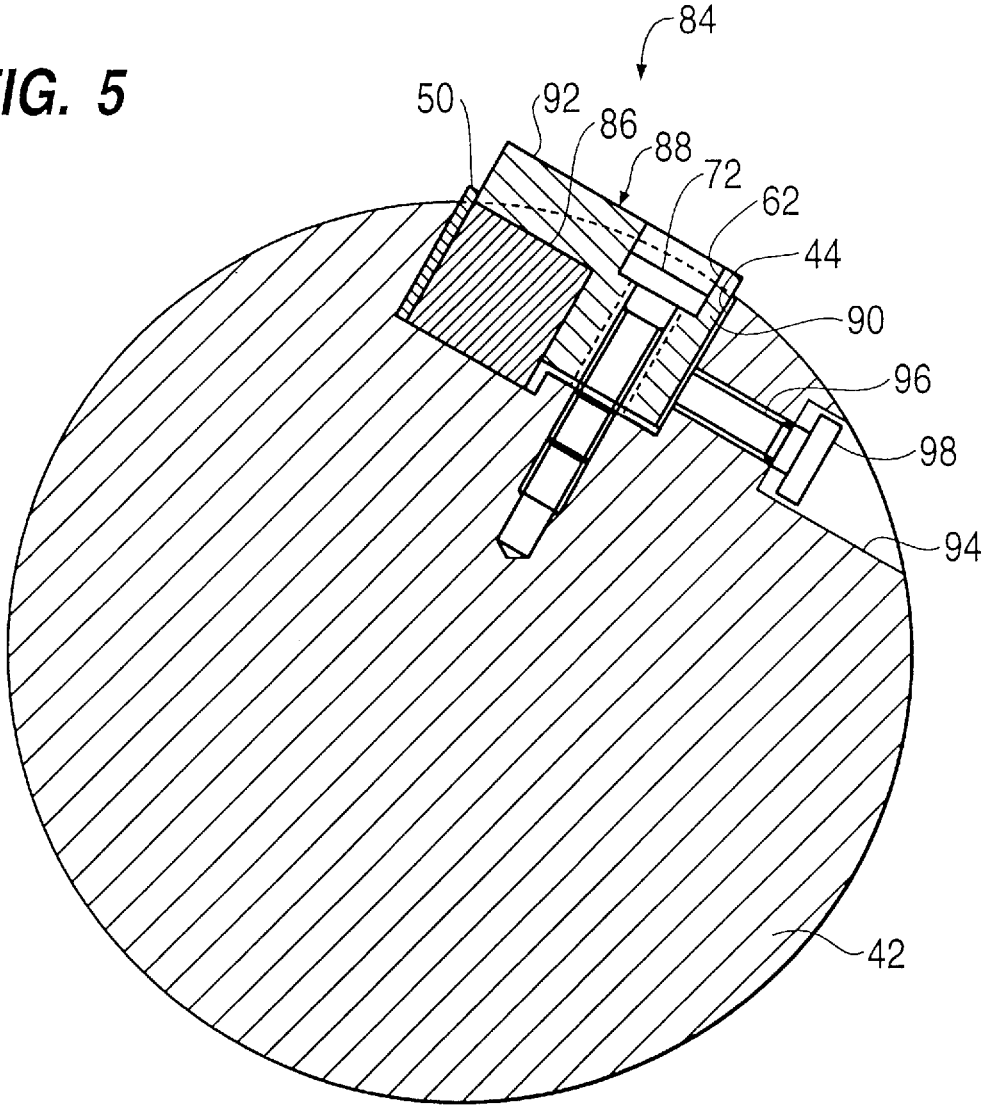
FIG. 5 is a cross-sectional view of an embodiment having a knife and one magnet.

FIG. 5 shows a magnet system 84 according to another embodiment. Here, the side walls of the recess 44 in the support 42 and the knife 50 are inclined with respect to the radial direction of the cylindrical support. The magnetic field is created by means of a single magnet 86 (or actually a row of magnets) having a square cross-section and being disposed on one side of the knife 50. The depth of the recess 44 in the portion accommodating the magnet 86 is so adapted to the dimensions of the magnet that one corner of the magnet lies substantially in the circumferential surface of the support 42.

In this embodiment, the clamping means for the magnet 86 and the knife 50 are formed by a bracket 88 made of aluminum and having an L-shaped cross-section. The bracket 88 has a radial leg 90 and a tangential leg 92 which embrace two adjacent surfaces of the magnet 86. The radial leg 90 is accommodated in the recess 44 and is provided with radially extending stepped holes 62 for the fastening screws 72 which are screwed into the support 42 from outside. In addition, the support 42 is formed with recesses 94 and threaded bores 96 into which set screws 98 are screwed-in in a direction perpendicular to the radial leg 90 of the bracket 88.

When the fastening screws 72 are tightened, the tangential leg 92 of the bracket 88 clamps the magnet 86 to the bottom of the recess 44. When the set screws 98 are tightened, they engage the radial leg 90 of the bracket 88 so that the magnet 86 and the knife 50 are clamped against the opposing wall of the recess 44. In this manner, the magnet 86 and the knife 50 are securely fixed in the support 42. The tightening force of the set screws 98 is properly adjusted, so that the tensions induced by thermal expansion or contraction of the knife 50 overcome the frictional forces between the support 42 and the knife and also between the knife 50 and the magnet 86.

Figure 6:
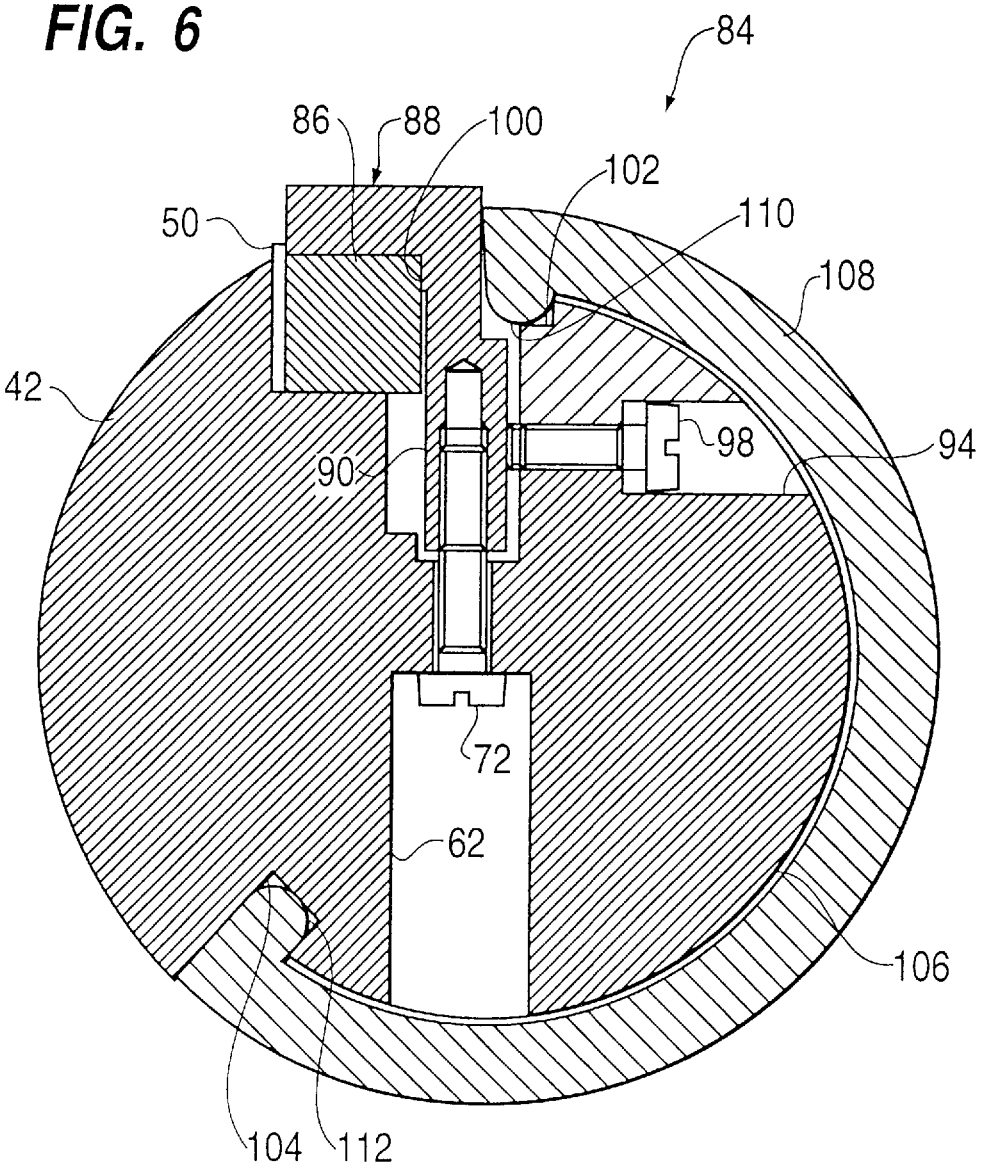
FIG. 6 is a cross-sectional view of a modification of the embodiment shown in FIG. 5.

FIG. 6 shows a modification of the magnet system 84 discussed above. In FIG. 6, the stepped holes 62 accommodating the heads of the fastening screws 72 are formed in the support 42, so that the vertical leg of the bracket 88 is drawn against the bottom of the recess by means of the fastening screws 72. The surface of the radial leg 90 facing the magnet 86 is formed with a step 100, so that the pressing force exerted by the set screws 98 is transferred to the magnet 86 and to the knife 50 mainly in the outer portions adjacent to the circumferential surface of the support 42.

The support 42 is formed with two longitudinal grooves 102, 104 and has a surface portion 106 with a reduced diameter extending over an arc of approximately 210° between the grooves 102, 104. A part-cylindrical magnetic shell 108 is fitted over the surface portion 106 of the support 42 and is fixed by means of ridges 110, 112 engaged in the grooves 102 and 104. The shell 108 may be mounted by snap-fastening or by thrusting it axially onto the support 42. The outer radius of the shell 108 is the same as the outer radius of the support 42, so that the shell 108 and the support 42 together form a cylindrical body. The shell 108 is made of ferromagnetic material and is magnetized to perform the same dust collecting function as the magnets 78' in FIG. 4. The longitudinal ridges 110, 112 engaged in the grooves 102, 104 allow for free thermal expansion and contraction of the shell 108. The shell 108 also has the function of covering the holes 62 and recesses 94 in the support.

Figure 7:
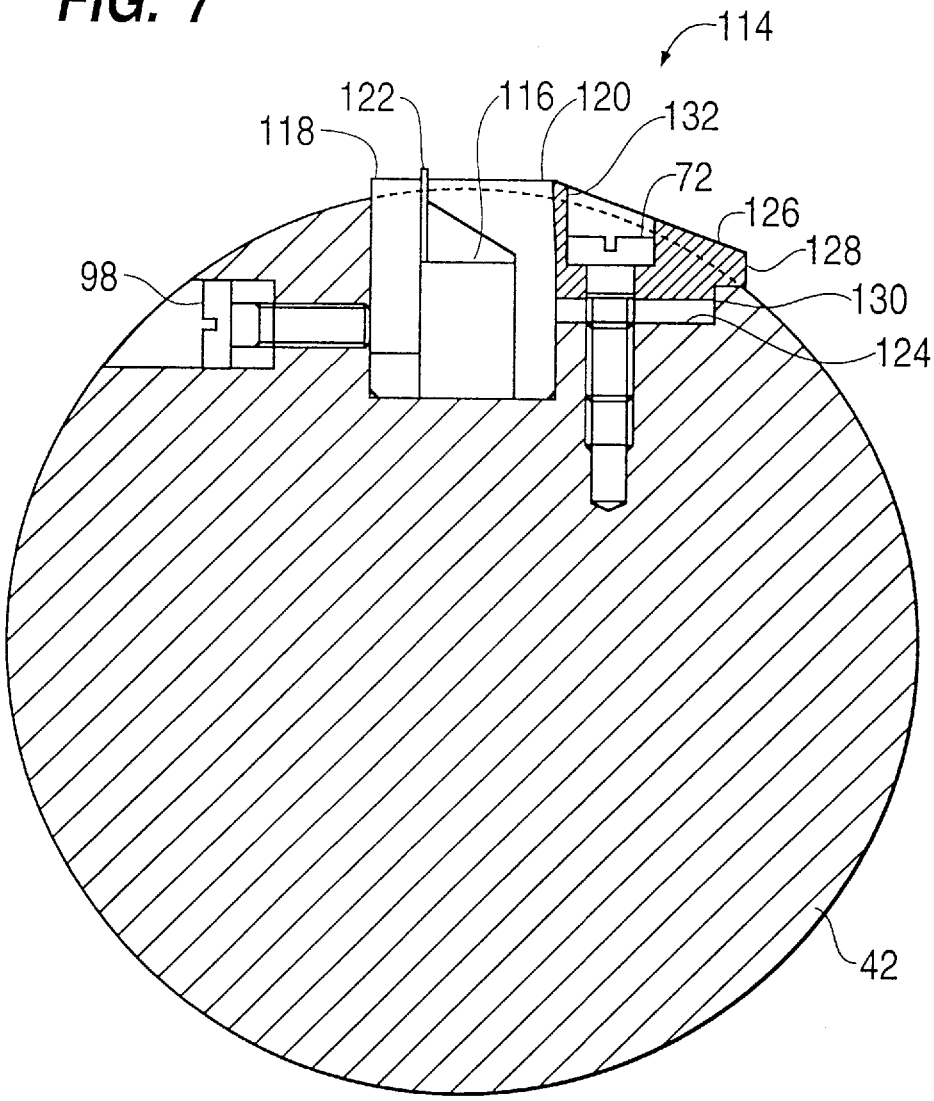
FIG. 7 is a cross-sectional view of a gap-type magnet system according to the invention.

Depending on the type of toner employed in the image forming process, it may be desirable to use a magnet system in which the magnetic field in the image-forming zone has a major component in a direction parallel to the direction of movement of the image forming element (drum 10 in FIG. 11). FIG. 7 shows such a type of magnet system 114 comprising a single magnet 116 (or row of magnets), a flat pole plate 118 arranged adjacent to one pole face of the magnet 116 and a L-shaped yoke 120 arranged adjacent to the opposite pole face of the magnet. At the circumferential surface of the support 42 the projecting ends of the pole plate 118 and the yoke 120 define a gap which is filled with a spacer 122 made of a non-magnetic material such as copper or brass.

Adjacent to the yoke 120 the recess in the support 42 has an enlargement 124 which accommodates a plate-like wedge member 126. In tangential direction of the support 42, the wedge member 126 is fixed between the yoke 120 and the outer side wall of the recess enlargement 124. A projection 128 at the outer edge of the wedge member 126 rests on an abutment surface of the support 42 immediately outside of the recess enlargement 124, so that the wedge member 126 is pivotable about a fulcrum 130.

Fastening screws 72 serve for tightening the wedge member 126 towards the bottom of the recess enlargement 124. The heads of the fastening screws are accommodated in a longitudinal channel which is delimited on one side by a wall 132. The wall 132 is slightly tapered radially inwardly and is held in mating engagement with a slightly chamfered surface of the yoke 120. Thus, when the wedge member 126 is tightened by means of the fastening screws 72, the wall 132 biases the yoke 120 against the spacer 122 with a biassing force which is largely determined by the resiliency of the wall 132.

The wedge member 126 is made of aluminum and has the same thermal expansion coefficient as the support 42. Since the clamping force exerted by the wedge member 126 is limited by the resiliency of the wall 132, the magnet 116, the pole plate 118, the yoke 120 and the spacer 122 are free to expand and contract upon temperature changes without causing bending or distortion of the support 42. On the other hand, the spacer 122 is clamped between the yoke 120 and the pole plate 118 which is itself supported by the wall of the recess of the support 42, so that the width of the gap between the pole plate 118 and the yoke 120 and the position of the gap, i.e. the spacer 122, in tangential direction of the support 142 is defined precisely. Thus, the gap between the pole plate 118 and the yoke 120 extending over the whole length of the magnet system can be kept straight not only in the radial direction of the support 42 but also in the tangential direction of the support. This assures a high quality of the images to be formed with the magnet system 114.

In the shown embodiment, set screws 98 are provided for additionally biassing the pole plate 118 against the magnet 116 and against the spacer 122, so that the tangential position of the spacer 122 in each lengthwise portion of the magnet system may be finely adjusted or corrected, if necessary.

Figure 8:
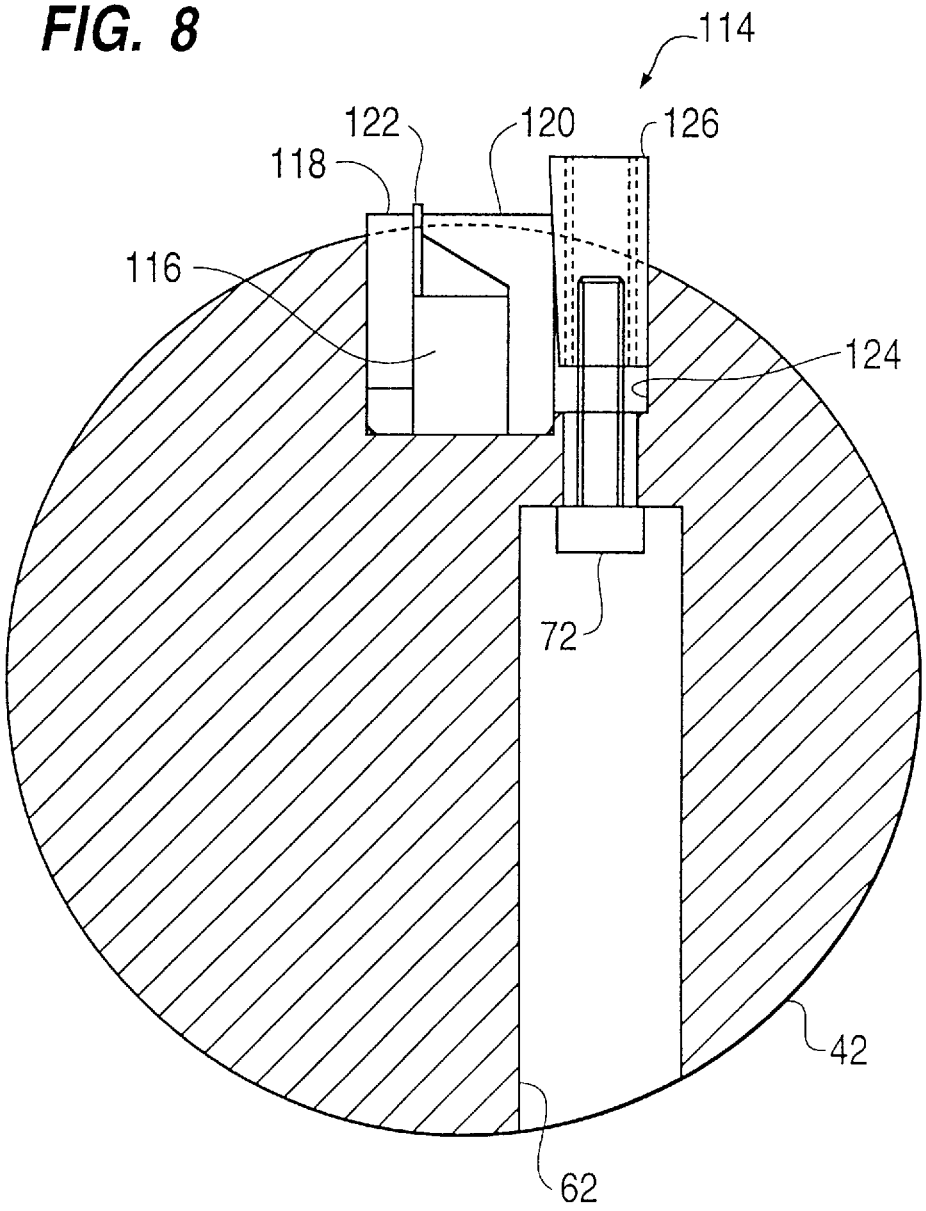
FIGS. 8, 9 and 10 are cross-sectional views of other embodiments of gap-type magnet systems.

FIG. 8 shows a modified embodiment in which the wedge member 126 is slidable in the recess enlargement 124 and is drawn towards the bottom of the recess by means of the fastening screws 72 which are inserted through holes 62 of the support 42. Here, the fastening screws 72 have to be tightened appropriately in order to provide on the one hand a sufficient clamping force for assuring tangential straightness of the spacer 122 and on the other hand to allow for free thermal expansion of the spacer and the ferromagnetic members in order to avoid thermal bending.

Figure 9:
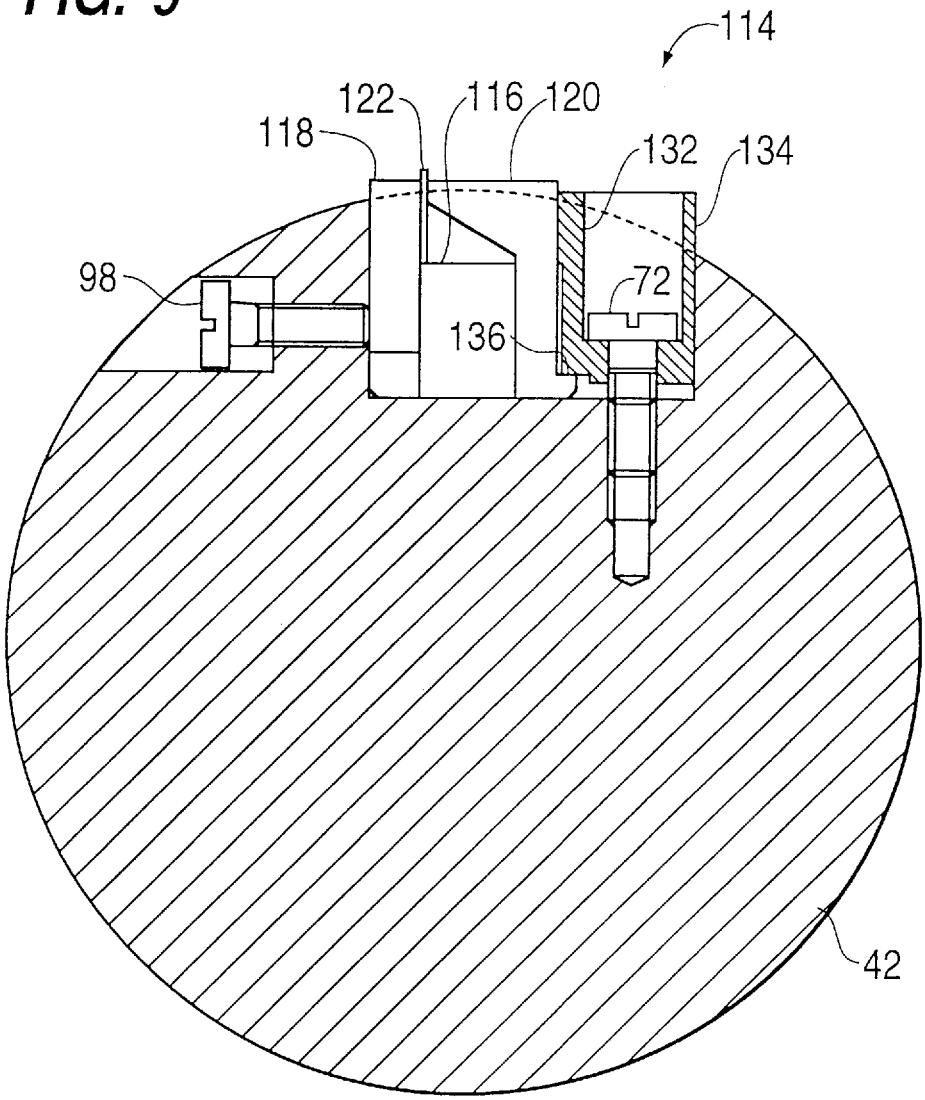

FIG. 9 shows an embodiment which is similar to the one shown in FIG. 7, but in which the wedge member 126 has been replaced by a locking member 134 the wall 132 of which engages the yoke 120 in the outer end portion thereof without having a substantial wedge effect. In order to immobilize the yoke 120 in radial direction, the bottom surface of the locking member 134 is biased against a projection 136 at the inner end of the yoke. The projection 136 has a certain play in tangential direction, so that the tangential position can be finely adjusted with the set screws 98.

Figure 10:
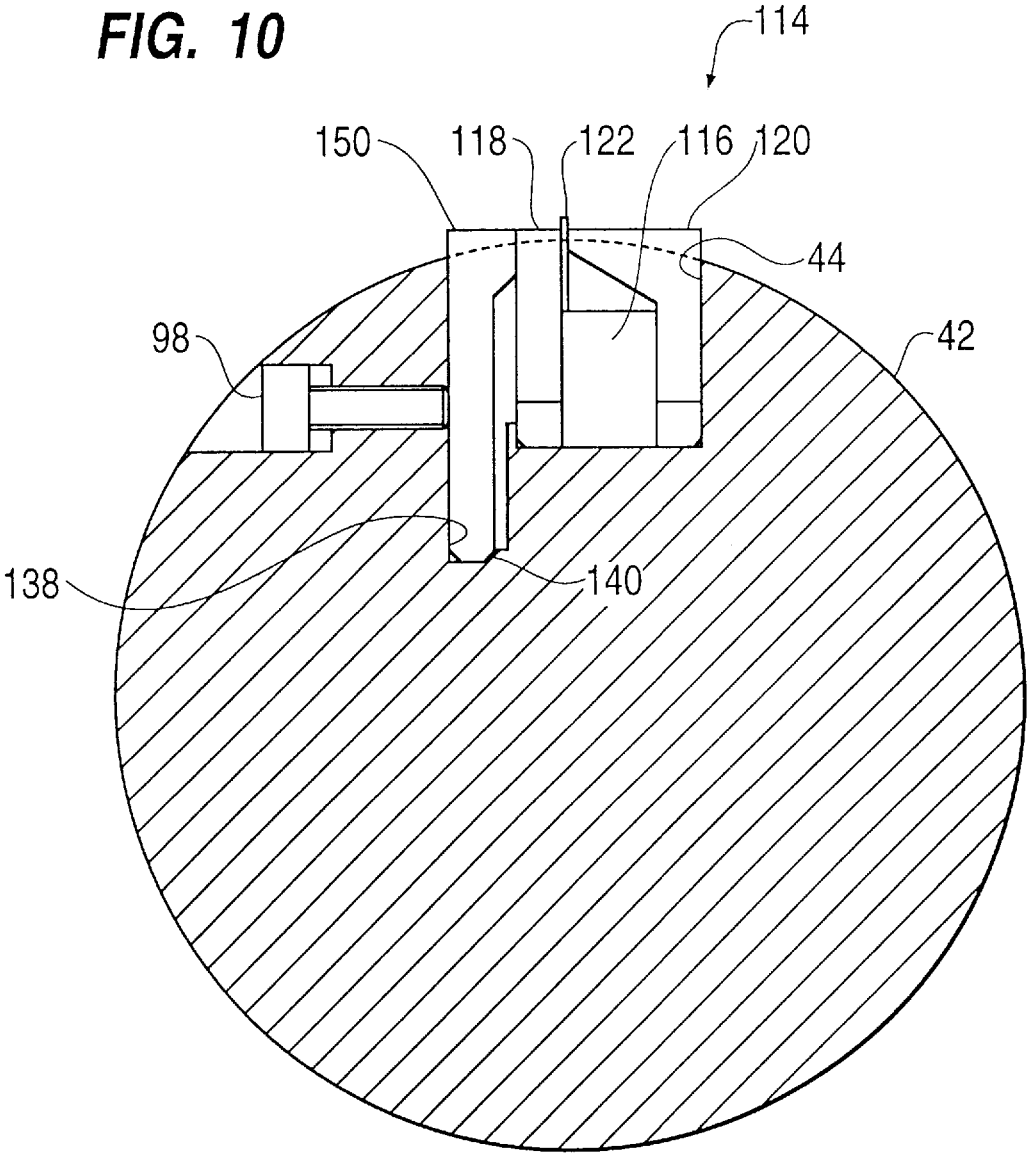

FIG. 10 shows a modified example in which the yoke 120 is rigidly supported at the side wall of the recess 44. The inward edge of the pole plate 118 is supported at the opposing wall of the recess 44. The set screws 98 engage a pressing plate 150 which is made of aluminum and is inserted into a slot 138 formed in the support 42. The pressing plate 150 is received in the slot 138 with a certain play and is supported at the lower edge, such that it is pivotable about a fulcrum 140. The outer end of the pressing plate 150 projects tangentially towards the pole plate 118 and is held in pressing engagement therewith when the set screws 98 are tightened. Thus, the pole plate 118, the yoke 120, the spacer 122 and the magnet 116 are clampingly fixed in the recess 44 by means of the pressing plate 150, and the clamping force is concentrated in the radially outward portion of the pole plate and the yoke.

The inward edge of the pressing plate 150 may be provided with a hook portion or projection similar to the projection 150 of the yoke 120 in FIG. 9. The hook or projection will prevent the pressing plate 150 from being drawn out of the slot 138 when the pressing plate is ground to be flush with the circumferential surface of the support 42.

In the embodiments described above, the knife 50, the pole plate 118 and the yoke 120 are made of ferromagnetic steel, and the permanent magnets 52', 54', 56' and 116 are made of a ferromagnetic alloy such as NdFeB which has been suitably magnetized. All these ferromagnetic bodies which have thermal expansion coefficients which are different from that of the material of the support 42 are non-positively held in position by clamping means, e.g. by the jig 46, the bracket 88, the wedge member 126, the locking member 134 or the pressing plate 150, which are preferably made of the same material as the support 42.

While specific embodiments of the invention have been described herein, it will occur to a person skilled in the art that various modifications can be made without departing from the scope of the invention as defined in the appended claims. For example, it is possible to mount the magnets, e.g. 116, in the magnet system in a non-magnetized condition and to magnetize them in their mounted position, thereby reducing distortions of the magnetic field due to positioning tolerances of the magnets.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. Magnet system for an image forming apparatus comprising an image-forming element and a rotatable sleeve, the image-forming element attracts a toner powder, the image-forming element being movable relative to said magnet system, the magnet system comprising:

a support surrounded by the rotatable sleeve and arranged such that the circumferential surface of the sleeve faces the surface of the image forming element in a linear image forming zone extending normal to the direction of movement of the image forming element;

at least one ferromagnetic body comprising magnets fixed in said support and defining a localized magnetic field in said image forming zone; and clamping means for engaging the ferromagnetic body to secure the ferromagnetic body in the support in a non-positive manner, thereby allowing differential thermal expansion of the magnets and the support.

2. The magnet system according to claim 1, wherein said clamping means comprise an elongated jig defining a slot and wherein the magnets of the at least one ferromagnetic body comprise a ferromagnetic knife, the ferromagnetic knife being fitted into said slot and having longitudinal play within the slot, the magnetic system further comprising means for preventing radial outward movement of the knife relative to the jig.

3. The magnet system according to claim 2, wherein said jig defines two longitudinal channels for accommodating magnets on both sides of the knife.

4. The magnet system according to claim 3, wherein said jig comprises a base and a cap detachably secured to the base, the slot and the two channels being defined in said cap and another channel for accommodating another magnet being defined in said base, the another magnet engaging an edge of the knife and the surfaces of the first two magnets facing inwardly of the support.

5. The magnet system according to claim 3, wherein a channel for accommodating another magnet is formed in the bottom surface of a recess of the support in which said jig is disposed.

6. The magnet system according to claim 1, wherein the support is formed with a recess having a side wall which is inclined relative to a radial direction of the support, the magnets of the at least one ferromagnetic body including a permanent magnet and a ferromagnetic knife, the permanent magnet being disposed in a lateral portion of said recess such that the knife is sandwiched between the inclined wall of the recess and the magnet, and said clamping means comprise a bracket having an L-shaped cross-section with a first and second leg, the bracket being disposed in the recess such that the first leg is between the magnet and the side wall of the recess opposite to the knife, and the second leg engages the surface of the magnet facing radially outwardly, the magnet system further comprising means for tightening the bracket radially and tangentially against the magnet.

7. The magnet system according to claim 6, wherein the means for tightening the bracket comprises screws.

8. The magnet system according to claim 1, wherein said at least one ferromagnetic body comprise the magnets, a pole plate and a yoke disposed on opposite sides of the magnets and defining a gap which is fillable with a non-magnetic spacer, and wherein said clamping means are arranged to tighten at least two of the magnets, the pole plate, the yoke and the spacer together.

9. The magnet system according to claim 8, wherein said clamping means comprise a wedge member.

10. The magnet system according to claim 9, wherein said wedge member is pivotable about a fulcrum defined by the support on the side of the wedge member opposite to the magnet.

11. The magnet system according to claim 9, wherein said wedge member has a wall resiliently biased against the yoke.

12. The magnet system according to claim 8, wherein said clamping means comprise a locking member which is radially slidable in a recess of the support adjacent to the magnets, the pole plate and the yoke, said locking member being tightenable against a projection of either the yoke or the pole plate at the bottom of said recess.

13. The magnet system according to claim 12, wherein said locking member has a wall resiliently biased against the pole plate.

14. The magnet system according to claim 1, wherein said clamping means comprise a rod member which extends over a entire length of the support, the rod member being fixedly secured in a recess of said support and being in engagement with said ferromagnetic body, the rod member being made from a material which has essentially a same thermal expansion coefficient as material of the support.

15. The magnet system according to claim 14, wherein said clamping means comprise an elongated jig defining a slot and wherein the magnets of the at least one ferromagnetic body comprise a ferromagnetic knife, the ferromagnetic knife being fitted into said slot and having longitudinal play within the slot, the magnetic system further comprising means for preventing radial outward movement of the knife relative to the jig.

16. The magnet system according to claim 15, wherein said jig defines two longitudinal channels for accommodating magnets on both sides of the knife.

17. The magnet system according to claim 16, wherein said jig comprises a base and a cap detachably secured to the base, the slot and the two channels being defined in said cap and another channel for accommodating another magnet being defined in said base, the another magnet engaging an edge of the knife and the surfaces of the first two magnets facing inwardly of the support.

18. The magnet system according to claim 16, wherein a channel for accommodating another magnet is formed in the bottom surface of a recess of the support in which said jig is disposed.

19. The magnet system according to claim 14, wherein the support is formed with a recess having a side wall which is inclined relative to a radial direction of the support, the magnets of the at least one ferromagnetic body including a permanent magnet and a ferromagnetic knife, the permanent magnet being disposed in a lateral portion of said recess such that the knife is sandwiched between the inclined side wall of the recess and the magnet, and said clamping means comprise a bracket having an L-shaped cross-section with a first and second leg, the bracket being disposed in the recess such that the first leg is between the magnet and the side wall of the recess opposite to the knife, and the second leg engages the surface of the magnet facing radially outwardly, the magnet system further comprising means for tightening the bracket radially and tangentially against the magnet.

20. The magnet system according to claim 19, wherein the means for tightening the bracket comprises screws.

21. The magnet system according to claim 14, wherein said at least one ferromagnetic body comprise the magnets, a pole plate and a yoke disposed on opposite sides of the magnets and defining a gap which is fillable with a non-magnetic spacer, and wherein said clamping means are arranged to tighten at least two of the magnets, the pole plate, the yoke and the spacer together.

22. The magnet system according to claim 21, wherein said clamping means comprise a wedge member.

23. The magnet system according to claim 22, wherein said wedge member is pivotable about a fulcrum defined by the support on the side of the wedge member opposite to the magnet.

24. The magnet system according claim 22, wherein said wedge member has a wall resiliently biased against the yoke.

25. The magnet system according to claim 21, wherein said clamping means comprise a locking member which is radially slidable in a recess of the support adjacent to the magnets, the pole plate and the yoke, said locking member being tightenable against a projection of either the yoke or the pole plate at the bottom of said recess.

26. The magnet system according claim 25, wherein said locking member has a wall resiliently biased against the pole plate.

* * * * *